United States Patent [19]

Huskins et al.

[11] 4,412,874

[45] Nov. 1, 1983

[54] SILANE BALLISTIC MODIFIER CONTAINING PROPELLANT

[75] Inventors: Chester W. Huskins; Leroy J. Williams, both of Huntsville, Ala.

[73] Assignee: The United States of America as represented by the Secretary of the Army, Washington, D.C.

[21] Appl. No.: 322,821

[22] Filed: Nov. 19, 1981

[51] Int. Cl.[3] ..... C06B 45/10

[52] U.S. Cl. ..... 149/19.2; 149/19.4; 149/19.9; 149/20

[58] Field of Search ..... 149/19.2, 19.4, 19.9, 149/20

[56] References Cited

U.S. PATENT DOCUMENTS

| | | | |
|---|---|---|---|
| 3,137,599 | 6/1964 | Alsgaard et al. | 149/19.2 |
| 3,665,862 | 5/1972 | Lane | 149/19 |
| 3,682,727 | 8/1972 | Heinzelmann et al. | 149/19 |
| 3,738,878 | 6/1973 | Green | 149/19 |
| 3,764,417 | 10/1973 | Hill et al. | 149/19.2 |
| 3,767,488 | 10/1973 | Seals | 149/7 |
| 3,986,908 | 10/1976 | Grebert et al. | 149/19.7 |
| 4,019,932 | 4/1977 | Schroeder | 149/19.1 |
| 4,019,933 | 4/1977 | Cucksee et al. | 149/19.9 |
| 4,047,990 | 9/1977 | Falterman et al. | 149/19.2 |
| 4,060,435 | 11/1978 | Schroeder | 149/19.2 |
| 4,088,518 | 5/1978 | Kehren et al. | 149/11 |
| 4,090,893 | 5/1978 | Cucksee et al. | 149/19.9 |
| 4,101,352 | 8/1978 | Poulin et al. | 149/19.2 |
| 4,210,474 | 7/1980 | Ramohalli | 149/19.2 |

*Primary Examiner*—Edward A. Miller

*Attorney, Agent, or Firm*—Robert P. Gibson; Anthony T. Lane; Jack W. Voigt

[57] ABSTRACT

A silicon compound as a burning rate catalyst for a solid propellant composition is disclosed along with the solid propellant composition for which the silicon compound is an effective catalyst. The silicon compound is selected from a class of silicon compounds characterized by having one or more silicon bonds selected from silicon to hydrogen bonds, silicon to nitrogen bonds, and silicon to carbon bonds. Representative silicon compounds of the described class of compounds include p-bis(dimethylsilyl) benzene, tris(dimethylsilyl) amine, triethylsilane, hexamethyldisilane, bis(dimethylamino) dimethylsilane, bis(dimethylamino) methylsilane, octylsilane, hexamethylcyclotrisilazane, and dimethyldiicyanatosilane. The burning rate of the solid propellant composition varies as a function of the silicon content in the propellant composition which is additionally comprised of hydroxyl terminated polybutadiene binder, an optional bonding agent which is the reaction product formed from equimolar quantities of 12-hydroxystearic acid and tris [1-(2-methylaziridinyl)]-phosphine oxide, an optional quick cure catalyst of triphenyl bismuthine, an oxidizer of 1 micrometer ultrafine ammonium perchlorate and 90 micrometers ammonium perchlorate, aluminum metal powder fuel, and a curing agent of isophorone diisocyanate.

6 Claims, 1 Drawing Figure

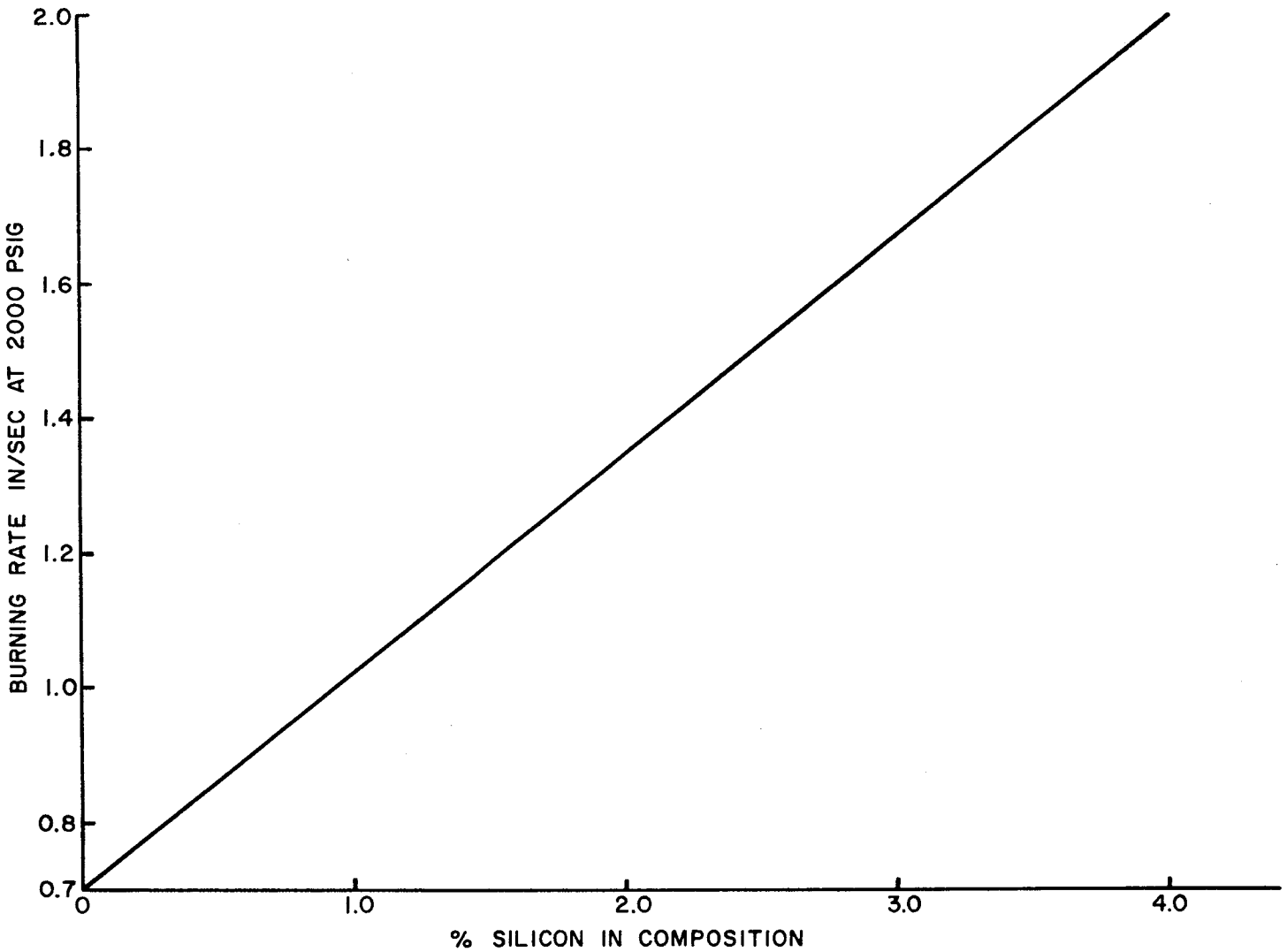
BURNING RATE IN/SEC AT 2000 PSIG
2.0
1.8
1.6
1.4
1.2
1.0
0.8
0.7
0
1.0
2.0
3.0
4.0
% SILICON IN COMPOSITION

SILANE BALLISTIC MODIFIER CONTAINING PROPELLANT

DEDICATORY CLAUSE

The invention described herein may be manufactured, used, and licensed by or for the Government for governmental purposes without the payment to us of any royalties thereon.

BACKGROUND OF THE INVENTION

High performance solid propellant fueled rocket motors require burning rate catalysts to achieve fast burn rates. Presently, n-hexylcarborane (NHC) is considered to be one of the most suitable burning rate catalysts for solid propellant fuels. NHC production by one process involves reacting 1-octyne with decaborane-14. The price and quantity limiting factor in the supply of NHC is the lack of an industrial process for synthesizing large quantities of decaborane inexpensively.

The carborane compounds are good reducing agents and when boron is oxidized, a significant amount of heat is released. This property has attributed to the efficiency of the carboranes as burning rate catalysts. Since the cost per pound of NHC is high, the cost for the increase in burning rate achieved is high. However, the high price has resulted in stimulating interest in seeking methods to produce NHC for a cheaper price or to investigate other compounds as catalysts to achieve the desired burning rates at a cheaper price, but without sacrificing propellant properties.

An object of this invention is to provide ballistic modifiers in combination with compatible propellant ingredients to yield an increase in the propellant composition burning rate.

A further object of this invention is to provide a propellant composition having an improved burning rate at high pressures resulting from employing a burning rate catalyst selected from silicon compounds having a bond selected from a silicon to hydrogen bond, a silicon to nitrogen bond, and a silicon to carbon bond.

SUMMARY OF THE INVENTION

A silicon compound selected from silicon compounds characterized by having one or more bonds which include a silicon to hydrogen bond, a silicon to nitrogen bond, and a silicon to carbon bond is employed as a burning rate catalyst for a high performance propellant composition having an improved burning rate at high pressure operations. The high performance propellant composition is comprised of the described silicon compound and the additional propellant ingredients of hydroxyl-terminated polybutadiene binder, a bonding agent (BA114) which is the reaction product formed from equimolar quantities of 12-hydroxystearic acid and tris[1-(2-methylaziridinyl)]phosphine oxide, 1 micrometer particle size ultrafine ammonium perchlorate oxidizer (UFAP) and 90 micrometer particle size ammonium perchlorate oxidizer (AP), aluminum metal powder fuel, triphenyl bismuthine quick cure catalyst, and isophorone diisocyanate (IPDI) curing agent. The polybutadiene binder in the experimental formulations varied from about 8.52 to about 13 weight percent while the silicon catalyst compound varied from about 5 to about 10 weight percent to provide a silicon content from about 1.91 to about 3.84 weight percent. UFAP was held constant at about 51.0 weight percent, and the 90 micrometer AP was held at about 15.0 weight percent. BA114 was employed at about 0.3 weight percent, the aluminum metal powder fuel was held at about 14.0 weight percent, triphenyl bismuthine was held at about 0.03 weight percent, and IPDI was varied from about 1.17 to about 1.69 weight percent. The burning rate achieved as compared with a control propellant indicates that the burning rate increases in proportion to the silicon content. The control propellant had a measured burning rate of about 0.70 inches per second while a 1.91–1.94 weight percent silicon catalyzed propellant had a measured burning rate of about 1.35–1.43 inches per second at 2000 psi.

BRIEF DESCRIPTION OF THE DRAWING

The single FIGURE of the drawing is a burning rate curve for propellant plotted against the silicon content in the composition.

DESCRIPTION OF THE PREFERRED EMBODIMENTS

Silicon compounds of the type which are characterized by having one or more bonds selected from a Si-H bond, a Si-N bond, and a Si-C bond have been found to function as burning rate catalysts for solid propellant compositions. The following silicon compounds in Table I are representative of the compounds having one or more of the preferred silicon to hydrogen bonds, silicon to nitrogen bonds, or silicon to carbon bonds.

TABLE I

Silicon Compounds Useful As Burning Rate Catalysts

| Silicon Compound | Molecular Weight | Boiling Point °C. | Percent Si |
|---|---|---|---|
| p-Bis(dimethylsilyl)benzene | 194.4 | 118 @ 35 mm | 28.90 |
| 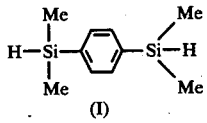 (I) | | | |
| Tris(dimethylsilyl)amine 95% | 195.5 | 152–5 | 43.10 |
| 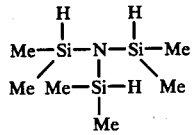 (II) | | | |
| Triethylsilane | 116.13 | 107–8 | 24.16 |
| 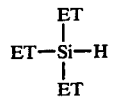 (III) | | | |
| Hexamethyldisilane | 146.4 | 112–3 | 38.2 |
| 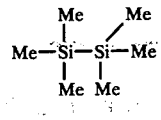 (IV) | | | |
| Bis(dimethylamino) dimethylsilane | 146.3 | 128–9 | 19.21 |

TABLE I-continued

Silicon Compounds Useful As Burning Rate Catalysts

| Silicon Compound | Molecular Weight | Boiling Point °C. | Percent Si |
|---|---|---|---|
| 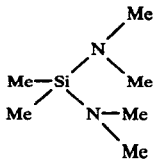 (V) | | | |
| Bis(dimethylamino) methylsilane | 132.3 | 112–3 | 21.4 |
| 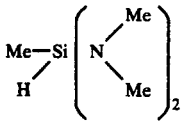 (VI) | | | |
| Octylsilane | 144.3 | 162–3 | 19.47 |
| 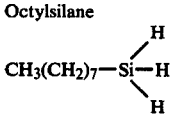 (VII) | | | |
| Hexamethylcyclotrisilazane | 219.5 | 186–8 | 38.39 |
| 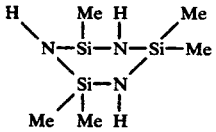 (VIII) | | | |
| Phenylsilane | 108 | 120 | 26.02 |
| 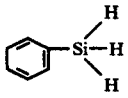 (IX) | | | |
| Dimethyldiicyanatosilane | 142.2 | 139–40 | 19.76 |
| 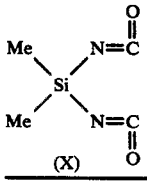 (X) | | | |

A baseline propellant composition, PLS-1, is set forth in Table II. Composition PLS-1 was used to evaluate the silicon compounds as a burning rate catalyst.

TABLE II

Baseline Propellant Composition

| Ingredient | PLS-1* Lot No. | Weight Percent |
|---|---|---|
| Hydroxyl terminated polybutadiene HTPB-R45M | 5538 | 17.43 |
| BA114 (bonding agent) | 092277 | 0.30 |

TABLE II-continued

Baseline Propellant Composition

| Ingredient | PLS-1* Lot No. | Weight Percent |
|---|---|---|
| UFAP 1 micrometer | VMA-163 | 51.0 |
| AP 90 micrometers | LAWT | 15.0 |
| Al (aluminum powder) | 5214 | 14.0 |
| Triphenyl bismuthine (TPB) | 54823 | 0.03 |
| Isophorone diisocyanate (IPDI) | 5399 | 2.24 |

*Burning rate established for this composition: 0.70 inches per second at 2000 psi.

Composition PLS-1 established a base line burning rate. The silicon compounds were evaluated by replacing the polymer (in most cases) with the liquid silicon compound which should in addition to being a burning rate catalyst serve as a plasticizer.

Composition PLS-2 in Table III is a composition wherein PLS-1 is modified by replacing a portion of the polymer binder and IPDI curing agent with hexamethyldisilane, compound (IV).

TABLE III

Composition PLS-2

| Ingredient | Lot No. | Weight Percent |
|---|---|---|
| HTPB-R45M | 5538 | 13.00 |
| Hexamethyldisilane | H7280 | 5.00 |
| BA114 | 092277 | 0.30 |
| UFAP 1 micrometer | VMA163 | 51.0 |
| AP 90 micrometers | LAWT | 15.0 |
| Al | 5214 | 14.0 |
| TPB | 54823 | 0.03 |
| IPDI | 5399 | 1.69 |

End of Mix (EOM) viscosity for PLS-1 was 1.8K poise 120° F. whereas PLS-2 had an EOM viscosity of 8.9K poise at 120° F. Composition PLS-2 processed well although EOM viscosity was 8.9K poise at end of mix.

Composition PLS-3 of Table IV is to evaluate hexamethyldisilane at the 10% level.

TABLE IV

Composition PLS-3

| Ingredient | Lot No. | Weight Percent |
|---|---|---|
| HTPB-R45M | 5538 | 8.52 |
| BA114 | 092277 | 0.30 |
| Hexamethyldisilane | H7280 | 10.00 |
| UFAP 1 micrometer | VMA163-10 | 51.00 |
| AP 90 micrometers | LAWT | 15.00 |
| Al | 5214 | 14.00 |
| TPB | 54823 | 0.03 |
| IPDI | 5399 | 1.17 |

Composition PLS-3 processed very well, but the mix temperature of 140° F. seemed to be too high because the mix viscosity changed rapidly after adding the IPDI. The mix could not be cast but was placed in a container for strand burning data.

Composition PLS-4 of Table V is to evaluate octylsilane at the 10% level.

TABLE V

Composition PLS-4

| Ingredient | Lot No. | Weight Percent |
|---|---|---|
| HTPB-R45M | 5538 | 8.52 |
| BA114 | 092277 | 0.30 |
| Octylsilane | | 10.00 |
| UFAP 1 micrometer | VMA163-10 | 51.00 |
| AP 90 micrometers | LAWT | 15.00 |
| Al | 5214 | 14.00 |

TABLE V-continued

| Ingredient | Composition PLS-4 Lot No. | Weight Percent |
|---|---|---|
| IPDI | 5399 | 1.17 |

Composition mixed well, but had a very low EOM viscosity, 0.07K poise at 120° F. Composition gassed with voids when heated to cure.

Another sample PLS-4-1 (containing octylsilane) was prepared to determine what cure to use to provide samples for burning rate measurements. Table VI sets forth composition PLS-4-1 which contains octylsilane.

TABLE VI

| Ingredient | Composition PLS-4-1 Lot No. | Weight Percent |
|---|---|---|
| HTPB-R45M | 5538 | 8.82 |
| BA114 | — | — |
| Octylsilane | 09820 | 10.00 |
| UFAP 1 micrometer | VMA163-10 | 51.00 |
| AP 90 micrometers | LAWT | 15.00 |
| Al | 5214 | 14.00 |
| IPDI | 5399 | 1.17 |

Composition mixed very well, but the EOM viscosity was extremely low 0.07K poise at 120° F. The sample cast very good; however, curing at 170° F., the silicon compound apparently decomposed or reacted giving a highly void filled composition. A small sample which was cured at 120° F. did not gas and was employed to determine burning rate data.

Composition PLS-5 of Table VII was prepared to evaluate hexamethylcyclotrisilazane.

TABLE VII

| Ingredient | Composition PLS-5 Lot No. | Weight Percent |
|---|---|---|
| HTPB-R45M | 5538 | 8.82 |
| Hexamethylcyclotrisilazane | H7250 | 10.00 |
| UFAP 1 micrometer | VMA163-10 | 51.00 |
| AP 90 micrometers | LAWT | 15.00 |
| Al | 5214 | 14.00 |
| IPDI | 5399 | 1.17 |
| Octylsilane | 09820 | Trace amount* |

*A trace amount of octylsilane as an additive was added to reduce viscosity. Composition mixed well but would not flow for casting. A small sample was placed in pan for cure and burn rate.

Composition PLS-6 of Table VIII was prepared to evaluate phenylsilane as a ballistic modifier.

TABLE VIII

| Ingredient | Composition PLS-6 Lot No. | Weight Percent |
|---|---|---|
| HTPB-R45M | 5538 | 8.82 |
| Phenylsilane | P0192 | 10.00 |
| UFAP 1 micrometer | VMA163-10 | 51.00 |
| AP 90 micrometers | LAWT | 15.00 |
| Al | 5214 | 14.00 |
| IPDI | 5399 | 1.17 |

The composition set up and became a powder in the mixer before all of the UFAP was added. Since this mix was discontinued no burning rate samples were evaluated.

Burning rate evaluations (average of 5 samples) which were obtained on propellant mixes PLS-1, PLS-2, PLS-3, PLS-4, and PLS-5 are listed below in Table IX.

TABLE IX

| Burning Rate Evaluations Sample | Burning Rate (in/sec at 2000 psi) |
|---|---|
| PLS-1 | 0.6994 |
| PLS-2 | 1.35 |
| PLS-3 | 1.91 |
| PLS-4-1 | 1.43 |
| PLS-5 | 1.91 |

Table X summarizes the data obtained on the evaluation of silicon compounds as ballistic modifiers.

TABLE X

Summary of Burning Rates and Silicon Content

| Compound Composition | | Percent Si in Compound | Percent Silicon in Composition | Burn Rate Inches/Second |
|---|---|---|---|---|
| Base line Composition | PLS-1 | 0 | 0 | 0.70 |
| Hexamethyldisilane | PLS-2 | 38.25 | 1.91 | 1.35 |
| Hexamethyldisilane | PLS-3 | 38.25 | 3.82 | 1.91 |
| Octylsilane | PLS-4 | 19.4 | 1.94 | 1.43 |
| Hexamethylcyclotrisilazane | PLS-5 | 38.35 | 3.84 | 1.91 |

The above data indicates that the burning rate is increased as a function of the percent silicon in the composition. The relationship between percent silicon in a propellant composition and the burning rates obtained is shown graphically in the drawing to illustrate the above conclusion. The selected silicon compounds are particularly suited for catalyst performance for the disclosed high performance propellant composition for operations under high chamber pressure environments. The compounds were carefully selected on the basis of their physical and chemical properties which met the basic requirements for compounding propellants. These properties include low melting points, high boiling points, high silicon contents, propellant compatibility, and basically, being good chemical reducing agents. A source of silicon compounds of the type specified is Petrarch Systems, Inc., P.O. Box 141, Levittown, PA 19059.

We claim:

1. A solid propellant composition employing a silicon compound as a burning rate catalyst, said solid propellant composition consisting essentially of said silicon compound, a hydroxyl terminated polybutadiene binder, ultrafine ammonium perchlorate of about 1 micrometer particle size, ammonium perchlorate of about 90 micrometers particle size, aluminum metal powder fuel, a curing agent of isophorone diisocyanate, an optional quick cure catalyst of triphenyl bismuthine, and an optional bonding agent which is the reaction product of equimolar quantities of 12-hydroxystearic acid and tris[1-(2-methylaziridinyl)]phosphine oxide, said silicon compound selected from the group of silicon compounds consisting of p-bis(dimethylsilyl)benzene, tris(-dimethylsilyl)amine, triethylsilane, hexamethyldisilane, bis(dimethylamino)dimethylsilane, bis(dimethylamino)-methylsilane, octylsilane, hexamethylcyclotrisilazane, and dimethyldiicyanatosilane.

2. The solid propellant composition as defined by claim 1 wherein said silicon compound selected is hexamethyldisilane and wherein said solid propellant composition is comprised of said silicon compound in an amount of about 5.0 weight percent, said hydroxyl terminated polybutadiene in an amount of about 13.0 weight percent, said bonding agent in an amount of about 0.30 weight percent, said ultrafine ammonium perchlorate in an amount of about 51.0 weight percent, said ammonium perchlorate in an amount of about 15.0 weight percent, said aluminum metal powder fuel in an amount of about 14.0 weight percent, said triphenyl bismuthine in an amount of about 0.03 weight percent, and said isophorone diisocyanate in an amount of about 1.69 weight percent.

3. The solid propellant composition as defined by claim 1 wherein said silicon compound selected is hexamethyldisilane and wherein said solid propellant composition is comprised of said silicon compound in an amount of about 10.0 weight percent, said hydroxyl terminated polybutadiene in an amount of about 8.52 weight percent, said bonding agent in an amount of about 0.30 weight percent, said ultrafine ammonium perchlorate in an amount of about 51.0 weight percent, said ammonium perchlorate in an amount of about 15.0 weight percent, said aluminum metal powder fuel in an amount of about 14.0 weight percent, said triphenyl bismuthine in an amount of about 0.03 weight percent, and said isophorone diisocyanate in an amount of about 1.17 weight percent.

4. The solid propellant composition as defined by claim 1 wherein said silicon compound selected is octylsilane and wherein said solid propellant composition is comprised of said silicon compound in an amount of about 10.0 weight percent, said hydroxyl terminated polybutadiene in an amount of about 8.52 weight percent, said bonding agent in an amount of about 0.30 weight percent, said ultrafine ammonium perchlorate in an amount of about 51.0 weight percent, said ammonium perchlorate in an amount of about 15.0 weight percent, said aluminum metal powder fuel in an amount of about 14.0 weight percent, said triphenyl bismuthine in an amount of about 0.03 weight percent, and said isophorone diisocyanate in an amount of about 1.17 weight percent.

5. The solid propellant composition as defined by claim 1 wherein said silicon compound selected is octylsilane and wherein said solid propellant composition is comprised of said silicon compound in an amount of about 10.0 weight percent, said hydroxyl terminated polybutadiene in an amount of about 8.82 weight percent, said ultrafine ammonium perchlorate in an amount of about 51.0 weight percent, said ammonium perchlorate in an amount of about 15.0 weight percent, said aluminum metal powder in an amount of about 14.0 weight percent, and said isophorone diisocyanate in an amount of about 1.17 weight percent.

6. The solid propellant composition as defined by claim 1 wherein said silicon compound selected is hexamethylcyclotrisilazane and wherein said solid propellant composition consists essentially of said silicon compound in an amount of about 10.0 weight percent, said hydroxyl terminated polybutadiene in an amount of about 8.82 weight percent, said ultrafine ammonium perchlorate in an amount of about 51.0 weight percent, said ammonium perchlorate of about 90 micrometers particle size in an amount of about 15.0 weight percent, said aluminum metal powder fuel in an amount of about 14.0 weight percent, said isophorone diisocyanate in an amount of about 1.69 weight percent, and additionally consists of a trace amount of octylsilane as an additive to reduce viscosity of said solid propellant composition.

* * * * *